US005920748A

United States Patent [19]

Kawai et al.

[11] Patent Number: 5,920,748

[45] Date of Patent: Jul. 6, 1999

[54] IMAGE FORMING APPARATUS CAPABLE OF ESTIMATING TONER CONCENTRATION

[75] Inventors: Atsushi Kawai, Aichi-Ken; Masaki Tanaka, Toyohashi; Tetsuya Sakai, Toyokawa, all of Japan

[73] Assignee: Minolta Co., Ltd., Osaka, Japan

[21] Appl. No.: 08/588,435

[22] Filed: Jan. 18, 1996

[30] Foreign Application Priority Data

Mar. 6, 1995 [JP] Japan ..... 7-045996

[51] Int. Cl.[6] ..... G03G 15/08

[52] U.S. Cl. ..... 399/59; 399/60

[58] Field of Search ..... 399/59, 60, 72, 399/44, 58

[56] References Cited

U.S. PATENT DOCUMENTS

| | | | |
|---|---|---|---|
| 4,956,668 | 9/1990 | Arnold et al. | 399/59 |
| 5,043,764 | 8/1991 | Arnold et al. | 399/59 |
| 5,146,274 | 9/1992 | Hattori et al. | 399/44 |
| 5,275,904 | 1/1994 | Shimizu et al. | 399/59 X |
| 5,579,091 | 11/1996 | Yamada et al. | 399/59 |

FOREIGN PATENT DOCUMENTS

| | | |
|---|---|---|
| 63-40179 | 2/1988 | Japan . |
| 63-292172 | 11/1988 | Japan . |
| 2-19873 | 1/1990 | Japan . |
| 5-27597 | 2/1993 | Japan . |
| 5-27598 | 2/1993 | Japan . |

*Primary Examiner*—William Royer

*Attorney, Agent, or Firm*—Burns, Doane, Swecker & Mathis, L.L.P.

[57] ABSTRACT

An image forming apparatus, such as an electrophotographic copier, forms a test image on a photosensitive member, under constant image forming conditions, and the amount of toner adhering to the photosensitive member is detected. The detected amount of toner is converted into a developer toner concentration, based on a conversion standard. The toner concentration is used to control the operation of a toner replenishment device. The conversion standard is periodically corrected by forming a test image using a developer having a known toner concentration, detecting the amount of adhered toner, comparing the detected result to a standard value, and selecting one conversion standard table from among a number of different conversion tables.

7 Claims, 8 Drawing Sheets

FIG. 9

| Density Table No. | Amount of Adhered Toner ($mg/cm^2$) | Grid Voltage Vg (V) | Charge Potential Vo (V) | Developing Bias Voltage Vb (V) |
|---|---|---|---|---|
| 0 | 0.625 | 500 | 480 | 280 |
| 1 | 0.510 | 540 | 520 | 320 |
| 2 | 0.445 | 570 | 545 | 345 |
| 3 | 0.400 | 600 | 570 | 370 |
| 4 | 0.380 | 630 | 590 | 390 |
| 5 | 0.340 | 670 | 630 | 420 |
| 6 | 0.305 | 710 | 660 | 440 |
| 7 | 0.275 | 750 | 700 | 480 |
| 8 | 0.250 | 800 | 750 | 540 |
| 9 | 0.210 | 900 | 820 | 620 |
| 10 | 0.180 | 1000 | 910 | 710 |

IMAGE FORMING APPARATUS CAPABLE OF ESTIMATING TONER CONCENTRATION

BACKGROUND OF THE INVENTION

1. Field of the Invention

The present invention relates to an image forming apparatus, and specifically relates to an image forming apparatus which forms an electrostatic latent image on the surface of a photosensitive member by an electrophotographic process and develops the latent image with toner.

2. Description of the Related Art

In an image forming apparatus of the electrophotographic type, two-component developers comprising a mixture of a carrier and a toner typically are used to develop an electrostatic latent image formed on the surface of a photosensitive member. When a two-component developer is used, the toner concentration Tc in the developer (the weight ratio of toner per total weight of developer) changes because toner alone is consumed in conjunction with image formation, such that a suitable amount of toner must be resupplied to the developer so as to maintain toner concentration Tc at a predetermined standard value.

Conventional toner replenishment control methods include well-known methods such as the ATDC method wherein the magnetic permeability of the developer is sensed via a magnetic sensor, or the amount of light reflected by the developer is detected by an optical sensor, so as to estimate the toner concentration Tc in the developer and resupply the required amount of toner. Other toner control techniques include AIDC methods, wherein the amount of light reflected by a toner test image formed on the surface of a photosensitive member under constant image forming conditions is detected by an optical sensor, to calculate the developing efficiency and estimate toner concentration Tc in the developer from the calculated developing efficiency, so as to resupply the required amount of toner.

While the ATDC method can be used in apparatuses which form full color images using toners of four colors, i.e., cyan, magenta, yellow, and black, disadvantages arise relating to black toner. That is, silica and the like are added to black toner to improve developing flow characteristics and improve image quality, but the bulk density of the toner fluctuates due to changes in humidity, thereby causing serious errors in toner concentration detection performed by magnetic sensors. Furthermore, black toner is commonly mixed with carbon black to enhance the deepness of its black color, but this mixing gives rise to other disadvantages when optical sensors are used because the spectral reflectivity characteristics approach that of the carrier.

Thus, the AIDC method has come to be used for toner replenishment of black toner.

In toner replenishment methods using AIDC, the amount of adhered toner of a toner test image is converted to a toner concentration using a table. Basically, this table is directly determined by data obtained experimentally using standard equipment. That is, a table is basically created using standard developing efficiencies which express the relationship between the toner concentration of the developer in a developing device and the amount of toner adhered to images developed by the developing device. Normally, copiers and printers have wide ranges of developing efficiencies due to errors introduced during manufacture. For example, the spacing between the photosensitive drum and the developing sleeve of a developing device can greatly affect developing efficiency, and small differences in this spacing appear from machine to machine. Accordingly, developing efficiencies will differ, i.e., the amount of toner adhered to the photosensitive drum will differ, from machine to machine even when the toner concentrations are identical. Thus, a disadvantage arises when the toner concentration is estimated by completely mechanical means using a table based on a standard developing efficiency, because of the effects of differences in developing efficiency from machine to machine.

SUMMARY OF THE INVENTION

An object of the present invention is to provide an image forming apparatus capable of accurately estimating toner concentration in a developer using AIDC methods regardless of differences in developing efficiency from machine to machine, so as to be normally capable of maintaining a constant toner concentration in a developing device.

When a user sets up a machine, loads new developer or replaces developer, a correction data setting mode is entered, in which toner test images are formed using a starter developer having a known toner concentration, and the amount of toner adhered on the test image is detected. The amount of adhered toner of the toner test image that is developed using the starter developer in a standard copier is compared with the detected value. Differences in developing efficiency from machine to machine, relative to a standard developing efficiency, become apparent when the detected amount of adhered toner is compared to a predetermined standard value. Thus, the conversion standard for converting the detected amount of adhered toner to a developer toner concentration must be corrected in accordance with the aforesaid differences appearing from machine to machine. In the copier described below, developer toner concentration is calculated in accordance with a corrected conversion standard. Thus, highly precise toner replenishment is possible, and toner concentration within a developer can be maintained at a predetermined standard value regardless of differences appearing from machine to machine.

BRIEF DESCRIPTION OF THE DRAWINGS

FIG. 9 is a table stored in data ROM 102 and used for image density control.

DESCRIPTION OF THE PREFERRED EMBODIMENTS

The preferred embodiments of an image forming apparatus according to the present invention are described hereinafter with reference to the accompanying drawings.

(1) Construction of the copying apparatus

Figure 1:
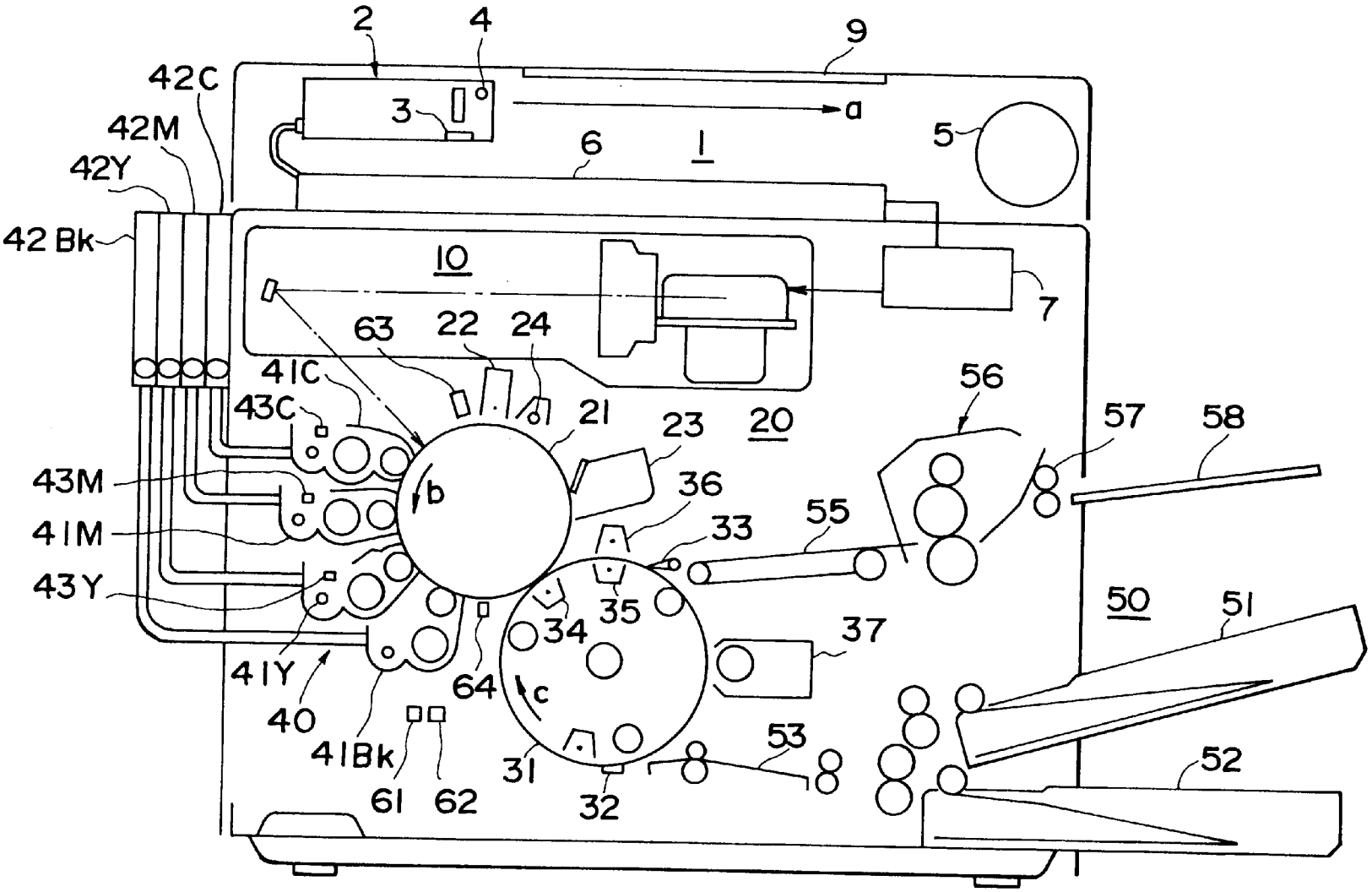
FIG. 1 show the internal construction of an embodiment of a full color digital copier of the present invention.

FIG. 1 shows the general construction of a full color copier of the digital type. This copier briefly comprises an image reader unit 1, a laser scanning unit 10, full color image forming unit 20, and paper supply unit 50.

Image reader unit 1 comprises a scanner 2 for reading the image of documents placed on glass platen 9, and image signal processor 6 for converting the scanned image data to print data. Scanner 2 is a well-known type provided with a direct-type color image sensor (CCD line sensor) 3, which reads the three colors of red (R), green (G), and blue (B) as it is driven in the direction of arrow "a" by motor 5, and outputs the density level of each color as image signals. Image signal processor 6 converts the image signals from sensor 3 into 8-bit print data corresponding to the four colors yellow (Y), magenta (M), cyan (C), and black (BK), and edits this print data as necessary prior to transmitting this data to a synchronization buffer memory 7.

Laser scanning unit 10 is a well-known type which modulates a laser diode to form an electrostatic latent image on the surface of photosensitive drum 21 rotating in the direction of arrow "b". Laser scanning unit 10 performs halftone correction on print data input from buffer memory 7 in accordance with the halftone characteristics of the photosensitive member, and thereafter subjects the print data to digital-to-analog (D/A) conversion to generate laser diode drive signals to modulate laser diode emissions based on the drive signals.

Full color image forming unit 20 comprises a core of photosensitive drum 21 and transfer drum 31. Arranged sequentially around the periphery of photosensitive drum 21 are charger 22, developing section 40, residual toner cleaner 23, and residual charge eraser lamp 24. Developing section 40 is provided sequentially from the top to bottom with developing devices 41C, 41M, 41Y, and 4lBk which respectively accommodate developers containing cyan, magenta, yellow, and black toners. These developing devices are driven in accordance with each formation of an electrostatic latent image of each color on the surface of photosensitive drum 21. Toners are stored in hoppers 42C, 42M, 42Y, and 42Bk, and are resupplied to the suitable developing device by a toner replenishment control described later.

Transfer drum 31 is arranged so as to be rotatably driven in the direction of arrow "c" at the same speed as photosensitive drum 21, and the toner image is transferred onto a copy sheet wrapped around the surface of the transfer drum. Transfer drum 31 is provided with a chuck member 32 for chucking the leading edge of the copy sheet on the drum, and separation member 33 for separating the copy sheet from the drum. Arranged on the interior side and exterior side of the transfer drum 31 are transfer charger 34, dischargers 35 and 36, and residual toner cleaner 37.

Paper supply unit 50 is provided with two stage paper trays 51 and 52, and feeds paper one sheet at a time from either tray 51 or 52 selected by an operator. The paper sheets that are fed from the trays are transported in a leftward direction through transport path 53, and wrapped around the exterior surface of transfer drum 31.

During full color image formation, cyan, magenta, yellow, and black images are sequentially formed on the surface of photosensitive drum 21, and the respective toner images are overlaid one upon another on the transfer sheet by sequential transfers via the discharge of transfer charger 34. When the four color images have been overlaid on the transfer sheet, chucking member 32 releases the transfer sheet and separation member 33 separates the transfer sheet from the transfer drum 31. The separated transfer sheet is transported to fixing device 56 by conveyor belt 55, whereupon the toner images are fixed on the transfer sheet, then ejected from discharge aperture 57 to tray 58.

Full color image forming unit 20 is provided with a humidity sensor 61 for detecting the humidity within the apparatus, a temperature sensor 62 for detecting the temperature, potential sensor 63 for detecting the surface potential of the photosensitive member, and AIDC sensor 64 for detecting the density of the toner test image. ATDC sensors 43C, 43M, and 43Y are respectively provided within color developing devices 41C, 41M, and 41Y to magnetically or optically detect the toner concentration for replenishment of color toner.

(2) Copying apparatus control mechanism

Figure 2:
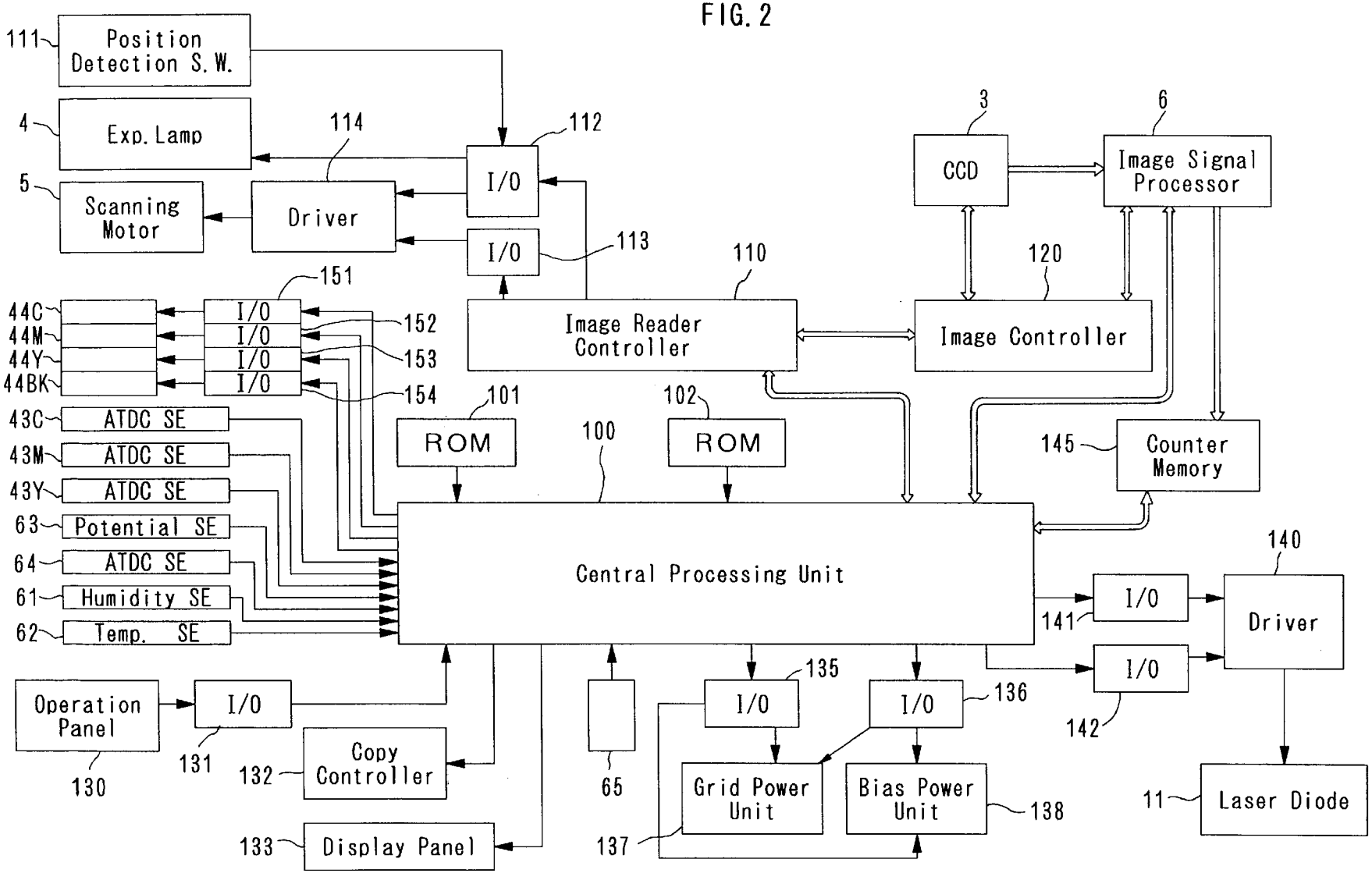
FIG. 2 is a block diagram showing the control circuit of said copier.

FIG. 2 shows the overall control circuit of the previously described copying apparatus, with the core of this control circuit comprising a central processing unit (CPU) 100. CPU 100 is provided with read only memory (ROM) 101 for storing control programs, and ROM 102 for storing various types of data.

Image reader controller 110 controls image reader unit 1. Image reader controller 110 controls the ON/OFF switching of exposure lamp 4 via drive I/O 112, by means of position signals transmitted from position detection switch 111 which indicates the position of a document placed on glass platen 9. The controller 110 further controls driver 114 of scanning motor 5 via the drive I/O 112 and parallel I/O 113. Image reader controller 110 is connected to image controller 120 via a bus. Image controller 120 is mutually connected to image sensor 3 and image signal processor 6 via buses. Image data read by image sensor 3 are input to image signal processor 6 and converted to print data.

Various analog signals are input to CPU 100 from potential sensor 63 which detects the surface potential of photosensitive drum 21, AIDC sensor 64 which optically detects the toner density (amount of adhered toner) of the toner test image, ATDC sensors 43C, 43M, and 43Y which detect the toner concentrations in developing devices 41C, 41M, and 41Y, humidity sensor 61, and temperature sensor 62. Copy mode signals set by an operator on operation panel 130 are input to CPU 100 via parallel I/O 131, and copy controller 132 and display panel 133 are controlled based on the various types of data input from data ROM 102, i.e., in accordance with the content of control ROM 101. CPU 100 controls the developing bias power unit 138 of the developing devices and grid power unit 137 of charger 22 via parallel I/O 135 and drive I/O 136, so as to control image density set by an operator via operation panel 130 or automatic image density control in accordance with output of AIDC sensor 64.

CPU 100 is connected to image processor 6 via a bus, and after correcting received print data via reference to gamma correction tables stored in data ROM 102, controls driver 140 which drives laser diode 11 via drive I/O 141 and parallel I/O 142. In the present embodiment, image halftone reproduction is accomplished by modulating the emission intensity of laser diode 11.

CPU 100 is also connected to image signal processor 6 via counter memory 145. Counter memory 145 stores the 8-bit per pixel print data received from image processor 6 for each single scan line of scanner 2. CPU 100 reads out one scan line of print data from counter memory 145 in accordance with scanner operation signals received from image reader controller 110. Counter memory 145 deletes the one scan line of print data when these data have been read out by CPU 100.

CPU 100 receives count values from lifetime counter 65 which counts the total number of copies made.

CPU 100 drives toner resupply motors 44C, 44M, and 44Y via drive I/O 151, 152, 153 based on toner density signals from ATDC sensors 43C, 43M, and 43Y to resupply toner from hoppers 42C, 42M, and 42Y and thereby maintain a predetermined standard toner concentration within developing devices 41C, 41M, and 41Y. Toner replenishment for developing device 4lBk, which accommodates black toner, is accomplished by driving toner resupply motor 44Bk via drive I/O 154 to resupply black toner from hopper 42Bk. This toner replenishment control is described later.

(3) Image density control

Figure 3:
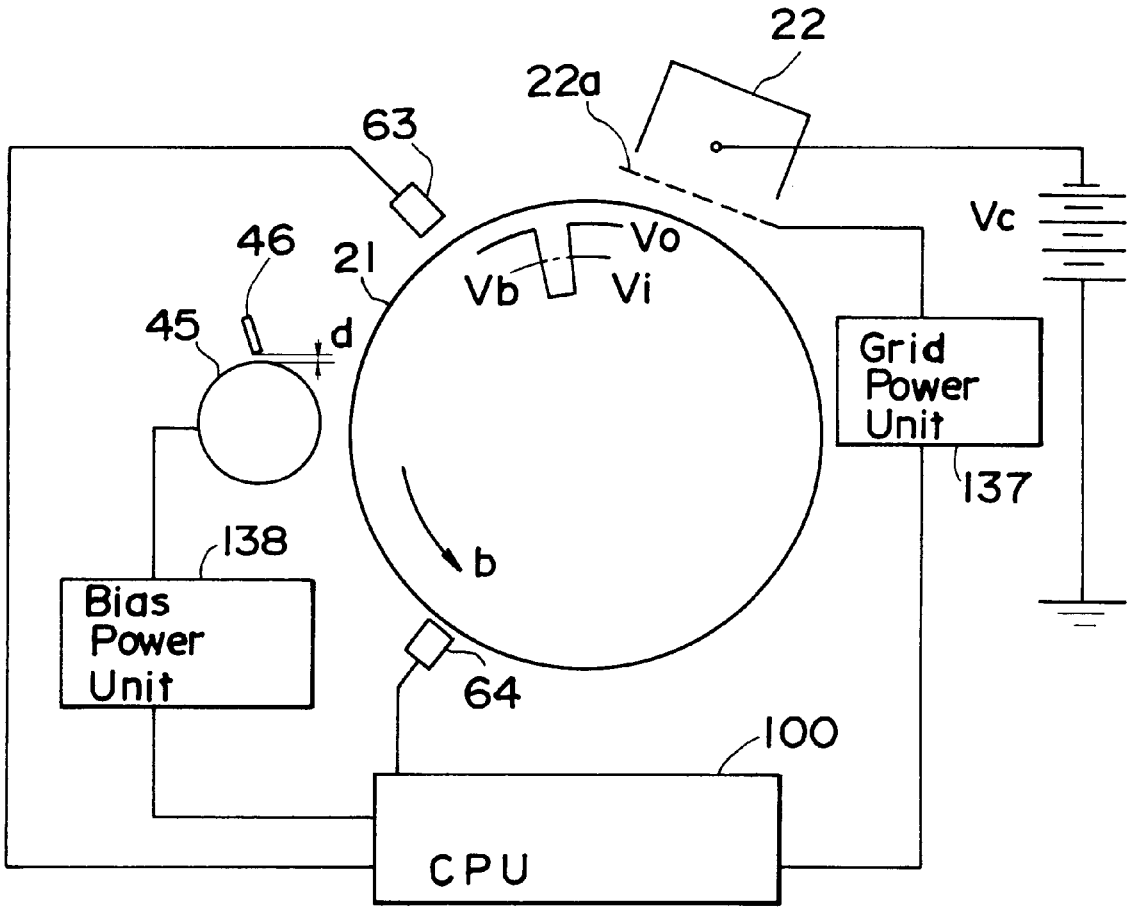
FIG. 3 is a block diagram showing the image density control circuit.

In the previously described copying apparatus, charging of photosensitive drum 21 is accomplished by applying a grid voltage Vg from power unit 137 to grid 22*a* of charger 22 having a discharge voltage Vc (FIG. 3). The charge potential V0 of photosensitive drum 21 prior to exposure is equal to grid voltage Vg, and charge potential V0 can be controlled by changing the grid voltage Vg.

The present embodiment utilizes so-called reversal development wherein toner adheres to the image region having a low potential Vi (0 volts) which is subjected to exposure by a laser beam emitted from laser scanning unit 10. If the charge polarity of the photosensitive member is negative, the toner charge polarity is also negative, and a negative polarity developing bias voltage Vb is applied to developing sleeve 45 of the developing device from power unit 138. In reversal development, toner adheres to the regions having a potential lower than the developing bias voltage Vb. When the image potential difference is large, developing efficiency improves, whereas when the image potential difference is low, developing efficiency is reduced. Developing efficiency refers to the amount of toner adhered to the photosensitive member per unit of developing potential difference.

The image density control forms a toner test image on photosensitive drum 21 by predetermined laser beam intensity (amount of exposure) and predetermined developing bias voltage Vb and predetermined grid voltage Vg, then detects the scattered reflection light from the toner test image by means of AIDC sensor 64. The detection signal is transmitted to CPU 100, which calculates the amount of adhered toner. If the grid voltage Vg and developing bias voltage Vb are changed to achieve a maximum image density level in accordance with the calculated amount of adhered toner, a constant image density can be maintained regardless of developing conditions.

The grid voltages Vg and developing bias voltages Vb capable of producing a maximum density level are set and stored as a table in data ROM 102.

An example of an image density control table is shown in FIG. 9. This table shows the grid voltages Vg, charge potential V0, and developing bias voltages Vb for each density table No. corresponding to an amount of adhered toner detected by AIDC sensor 64.

(4) Toner density estimation by AIDC

The relationship between developing efficiency and toner density in accordance with processing parameters of image formation, is described below.

Figure 4:
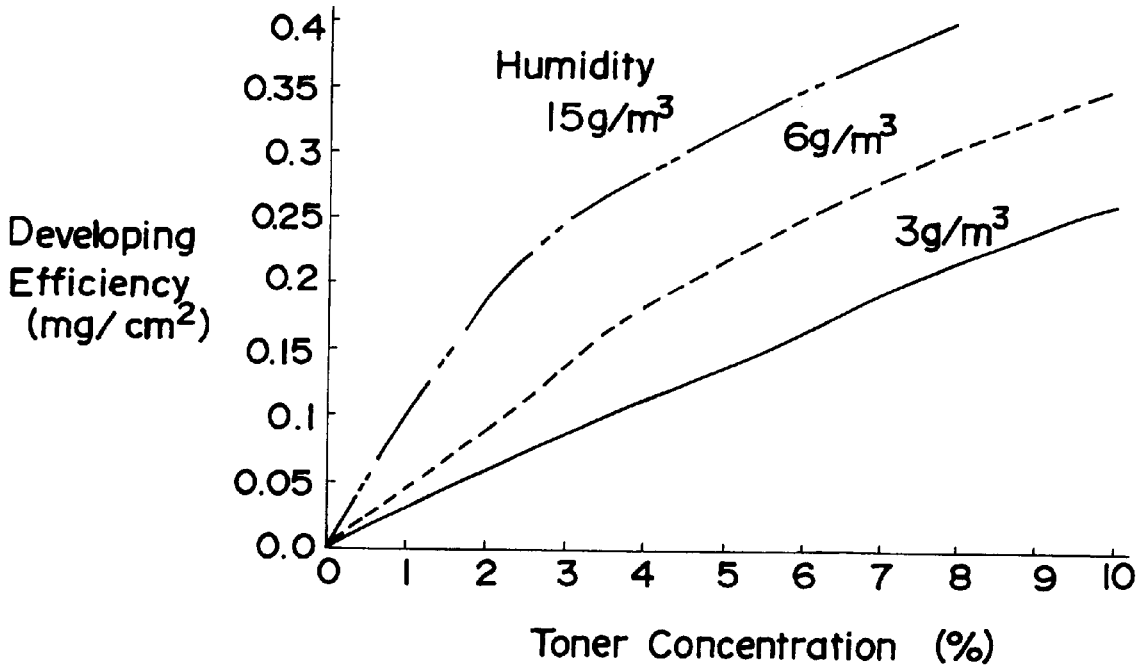
FIG. 4 is a graph showing the relationship between toner concentration and developing efficiency by humidity.

In general, toner concentration in a developer can be estimated by detecting the amount of adhered toner (developing efficiency) per unit area of an image formed under constant image forming conditions. Developing efficiency is known to fluctuate, however, due to changes in various parameters, even when toner density remains constant. Consider humidity fluctuations, for example; FIG. 4 shows the relationship between toner density and developing efficiency when humidity is 3 g/m$^3$, 6 g/m$^3$, and 15 g/m$^3$. As humidity increases, the toner charge decreases and developing efficiency rises, whereas when humidity decreases, the toner charge increases and developing efficiency drops.

Figure 5:
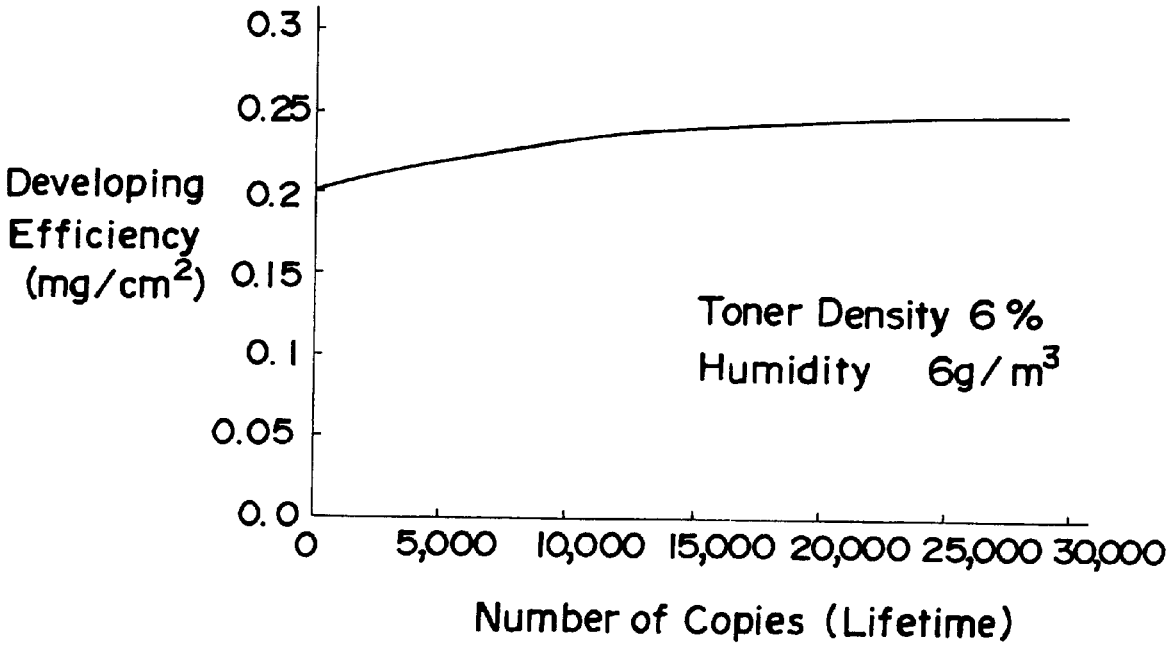
FIG. 5 is a graph showing the relationship between copy number and developing efficiency.

Furthermore, developing efficiency fluctuates in conjunction with carrier fatigue accompanying the ever-increasing number of copies made (lifetime). FIG. 5 shows an example of the initial relationship between the number of copies and developing efficiency at the start of service (i.e., toner density of 6%, humidity of 6 g/m$^3$). The copy number corresponds to carrier durability, such that as the number of copies increases, the toner charge is reduced through carrier fatigue and developing efficiency tends to rise.

Changes in temperature, type of copy mode, and time between copies (developing device idle time) and the like are also known to cause fluctuation in developing efficiency. Although toner density estimation is corrected from the lifetime copy number, humidity, temperature and detected developing efficiency in the present embodiment, other parameters may be considered.

Relative humidity and absolute humidity are discussed below. Relative humidity is the ratio of the vapor content e actually contained in a constant volume of air and the saturated vapor content E of the same air expressed as a percentage ((e/E)×100). In contrast, absolute humidity is the vapor content contained in a volume of one cubic meter of air expressed in g/m$^3$ units. Absolute humidity is determined from the temperature and the relative humidity and the saturated vapor pressure at the given temperature.

In the present embodiment, saturated vapor pressure is determined from the detection values of humidity sensor 61 and temperature sensor 62 with reference to the data tables stored in data ROM 102, and absolute humidity is obtained by the calculation method described below.

$$A=(0.01058\times H\times P)/(1+0.00366\times T)$$

where:

A is Absolute humidity (g/m$^3$)

H is Relative humidity (%)

T is Temperature (°C.)

P is Saturated vapor pressure at temperature T (mmHg)

Figure 6:
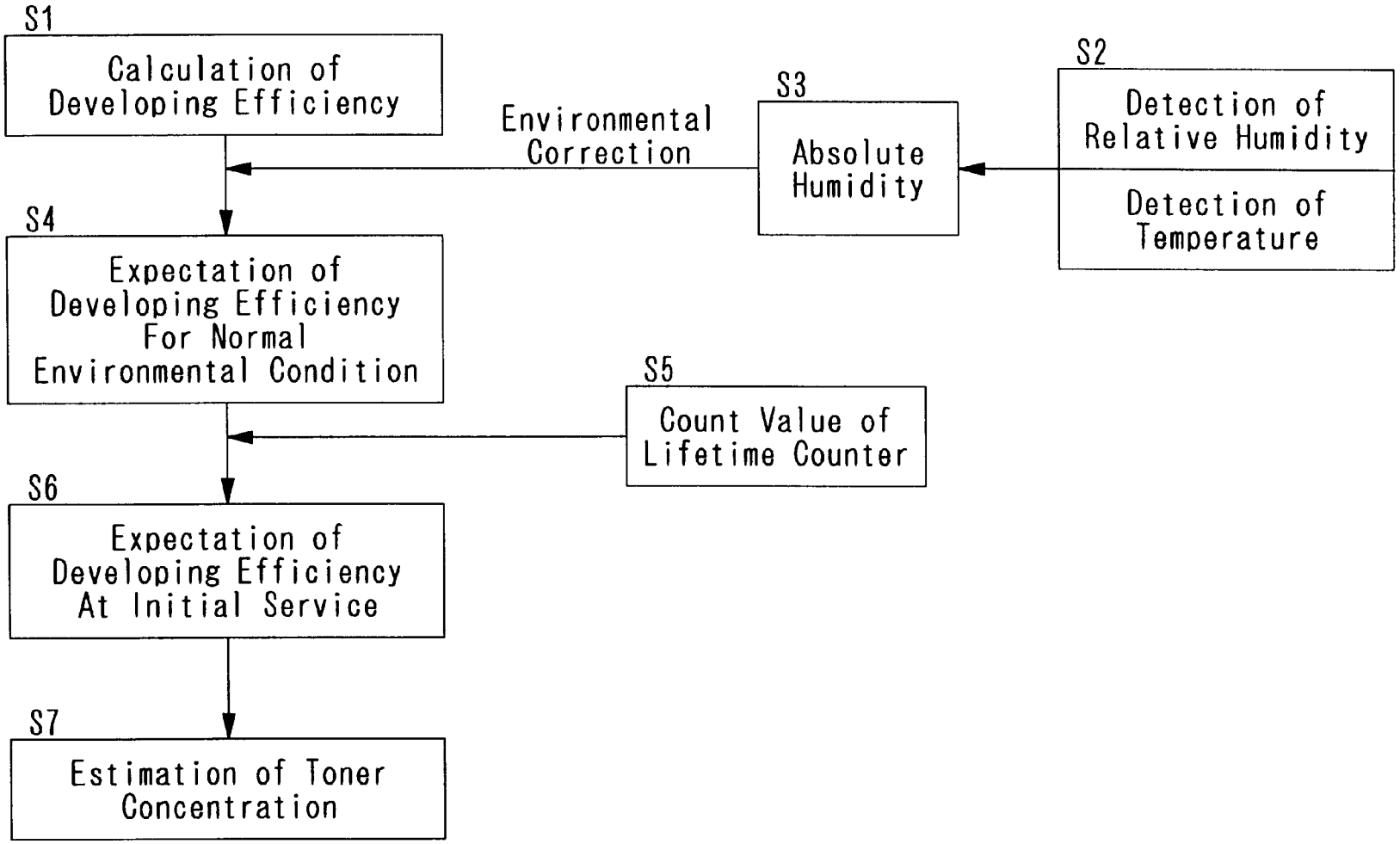
FIG. 6 is a flow chart showing the sequence of toner concentration estimation.

The sequence for estimating toner density is described hereinafter with reference to FIG. 6.

First, the developing efficiency is calculated (step S1). When one image forming operation is completed, a latent image test pattern is formed on the surface of photosensitive drum 21 with a predetermined grid voltage and exposure, and the potential of this latent image is measured by potential sensor 63. The latent image test pattern is developed by developing device 4lBk under a predetermined developing bias voltage so as to obtain a toner test image. The developing potential difference is the difference between the developing bias voltage and the potential measured by potential sensor 63. Then, the amount of light reflected from the toner test image is measured by AIDC sensor 64, and the amount of adhered toner is calculated. The determined amount of adhered toner is divided by the developing potential difference to calculate developing efficiency. The developing efficiency is defined as the amount of adhered toner per unit area per 100 V developing potential difference.

Developing efficiency thus calculated is corrected due to changes in environmental conditions and developer durability, so as to be converted to a developing efficiency for normal environmental conditions at initial service. Environmental correction is accomplished by detecting the relative humidity by sensor 61 and detecting the temperature by sensor 62 (step S2), and calculating the absolute humidity A by the previously described calculation method (step S3). An expected developing efficiency for normal environmental conditions is determined based on the absolute humidity thus determined (step S4). The count value of lifetime counter 65 (the current lifetime number of copies) is obtained (step S5), and an expected developing efficiency at initial service is determined (step S6). These calculated data are created beforehand by actual experiments as depicted in FIGS. 4 and 5, and stored in data ROM 102.

Figure 7:
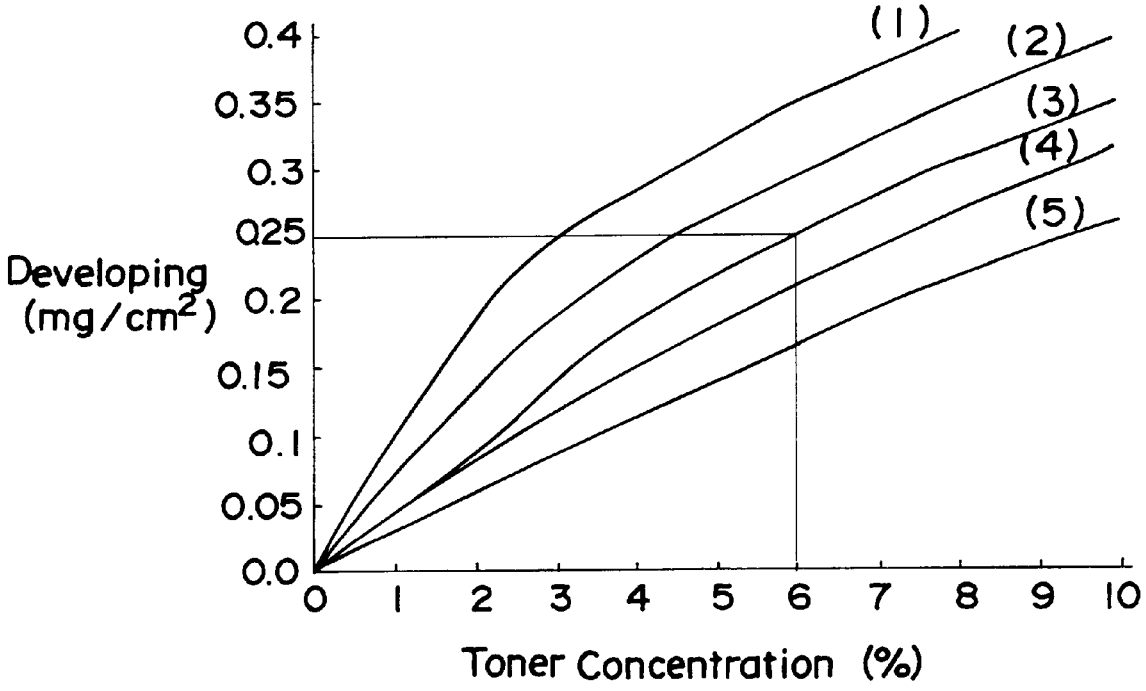
FIG. 7 is a graph showing the relationship between toner density and developing efficiency.

The relationship between toner concentration and developing efficiency under normal environmental conditions and initial service life are described by curve (3) in FIG. 7. This relationship is stored beforehand in data ROM 102 as a lookup table. Toner concentration is estimated from the corrected expected developing efficiency (step S7).

(4) Developing efficiency differences from machine to machine

The curve (3) shown in FIG. 7 was created based on data obtained experimentally using a standard copier. Curves (1), (2), (4) and (5) relate to other copies of the same type as the standard copier, but having developoing efficiency characteristics which are different from those of the standard copier.

That is, the developing efficiency in individual copiers will differ due to small structural differences produced when assembling photosensitive drum 21 and developing unit 40. For example, the amount of transported developer per unit surface area of developing sleeve 45 will vary depending on the spacing d between regulating blade 46 and developing sleeve 45 (see FIG. 3). Although this spacing d is normally set at 0.5 mm, there is an error tolerance of ±0.05 mm when each machine is assembled. This tolerance causes differences in the amount of transported developer, which produces differences in developing efficiency even when the toner concentration in developing devices 41Bk is the same. In addition to the aforesaid spacing d, differences in the spacing between developing sleeve 45 and photosensitive drum 21 as well as differences in the developing bias voltage cause fluctuation in developing efficiency from machine to machine. Thus, the developing efficiency of a particular machine may be higher or lower from that of a standard machine.

(5) Methods of compensating for differences between individual machines

Normally, toner concentration within a developing device fluctuates around a standard toner concentration due to toner concentration during copying and suitable toner replenishment, and accurate toner concentration cannot be estimated due to developing efficiency differences arising between individual machines. When a copier is set up, or developer is replaced, however, a so-called starter developer having an accurately known toner concentration is introduced into the developing device. AIDC is executed in conjunction with this known toner concentration, so as to detect the amount of adhered toner on a toner test image for calculating developing efficiency. If this calculated developing efficiency is compared to a standard developing efficiency obtained using an identical starter developer in standard equipment, is possible to know to what degree the developing efficiency of a specific copier is higher or lower than that of the standard copier.

Accordingly, in the present invention, a service person can execute a correction data setting mode to automatically set correction data for an individual machine during initial setup of the copier or when replacing black developer. The correction data setting mode operates differently from the copying operation, and can be set so as to not be available for use by an operator. This mode is automatically executed by a specific start signal input by service personnel to determine developing efficiency correction data for a particular copier, which is then stored in data ROM 102.

(6) Correction data setting mode

Figure 8:
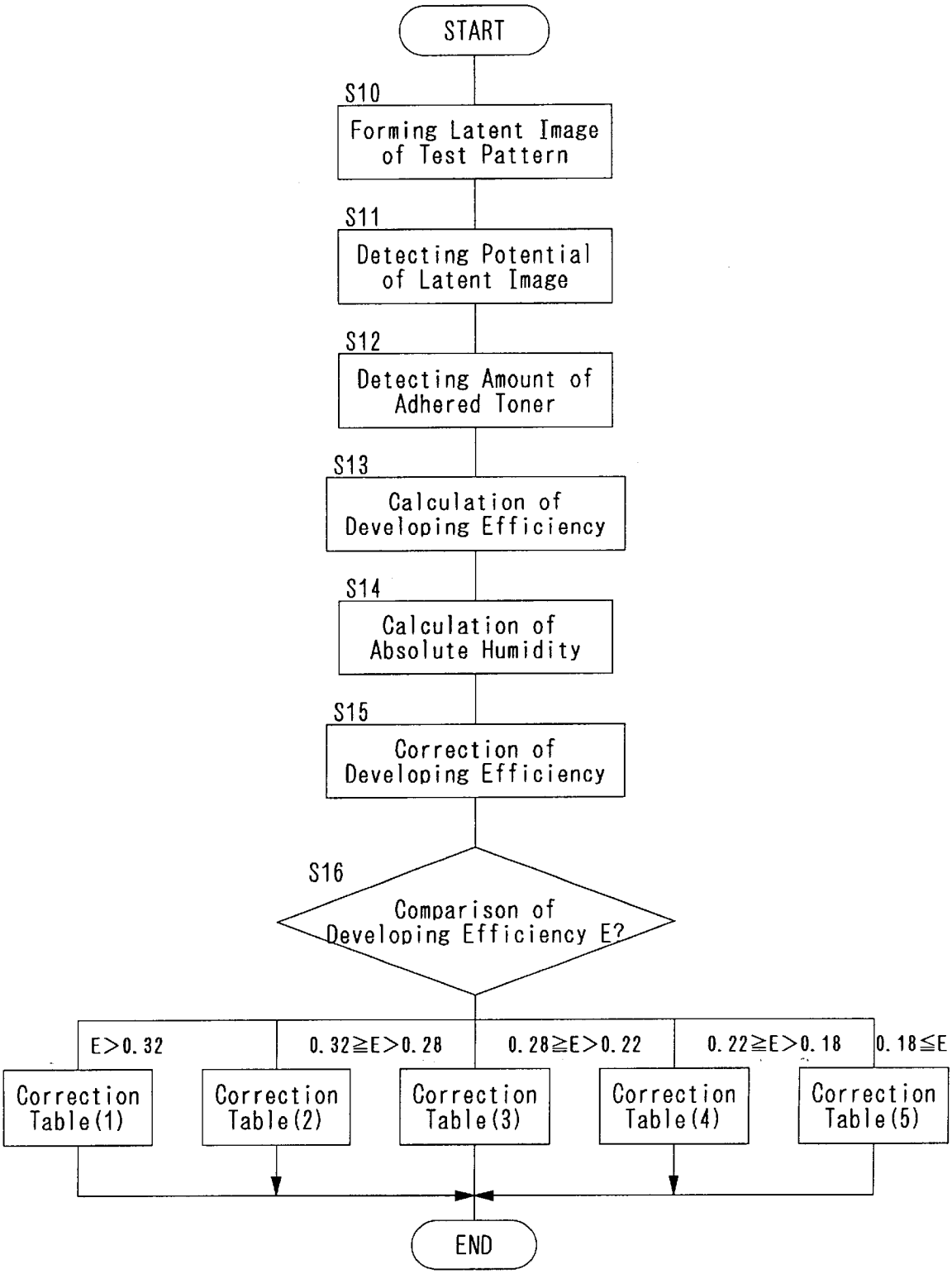
FIG. 8 is a flow chart showing the control sequence of the developer efficiency correction setting mode.

The control sequence of the correction data setting mode for developer efficiency is described hereinafter with reference to FIG. 8. As previously mentioned, this mode is executed when initially setting up the copier or replacing developer.

In step S10, a latent image of a test pattern is formed on the surface of photosensitive drum 21 by a predetermined grid voltage and exposure, and in step S11 the potential of the latent image is detected by potential sensor 63. The developing potential difference is determined from the detected latent image potential and the developing bias voltage. Then, in step S12, the test pattern is developed, and the amount of adhered toner is detected by AIDC sensor 64. In step S13, developing efficiency is calculated by dividing the amount of adhered toner by the developing potential difference. In the present embodiment, the developing efficiency is stipulated to be the amount of adhered toner per 100 V developing potential difference ($mg/cm^2$/ 100 V).

The developing efficiency calculated in step S13 is obtained using a starter developer unaffected by durability characteristics, but since developing efficiency may be affected by environmental conditions when the correction data setting mode is executed, the developing efficiency is corrected under normal environmental conditions. That is, in step S14, the absolute humidity is calculated, and in step S15 the developing efficiency is corrected using the conversion data previously described in reference to FIG. 4.

Developing efficiency E obtained as described above is compared to a standard developing efficiency for a starter developer having a known toner concentration (6% in the present embodiment). The relationship between the standard toner concentration and standard developing efficiency is shown by curve (3) in FIG. 7. In a specific example, the standard developing efficiency at a toner concentration of 6% is 0.25 $mg/cm^2$/ 100 V. In step S16, corrected data are determined by comparing the developing efficiency E determined at step 515 with the standard developing efficiency. In the present embodiment, a method is used for selecting one correction table from among a plurality of correction tables (1)~(5) prepared by comparing the developing efficiency E and the standard developing efficiency. Correction tables (1)~(5) are stored in data ROM 102 as lookup tables corresponding to the relational curves (1)~(5) for developing efficiency and toner concentration shown in FIG. 7.

For example, if developing efficiency E is greater than 0.32 $mg/cm^2$/ 100 V, correction table (1) is selected; if developing efficiency E is such that $0.32 \geqq E > 0.28$, correction table (2) is selected; if developing efficiency E is such that $0.28 \geqq E > 0.22$, correction table (3) is selected; if developing efficiency E is such that $0.22 \geqq E > 0.18$, correction table (4) is selected; and if developing efficiency E is less than or equal to 0.18, correction table (5) is selected.

On the other hand, during normal copy operation, AIDC is executed to calculate developing efficiency, and this developing efficiency is corrected with reference to one correction table among a plurality of correction tables (1)~(5) selected by the aforesaid correction data setting mode. Toner concentration within developing device 4lBk is estimated based on the corrected developing efficiency, an amount of toner to be resupplied is calculated to achieve a predetermined concentration of toner in developing device 41Bk, and toner replenishment is accomplished.

The image forming apparatus of the present invention is not limited to the previously described embodiments, and may be variously modified insofar as such modifications do not depart from the scope of the present invention.

Specifically, the present invention may be adapted to full color analog copiers, digital or analog monochrome copiers, or laser printers in addition to the previously described full color digital copiers.

What is claimed is:

1. An image forming apparatus comprising:

a photosensitive member on which a latent image is formed;

a developing device which stores developer including toner and develops the latent image on said photosensitive member with toner;

detection means for detecting an amount of toner adhered to a developed test image formed on the surface of said photosensitive member under constant image forming conditions;

conversion means for converting the detected amount of adhered toner into toner concentration of developer stored in said developing device based on a conversion standard; and correction means for correcting the conversion standard of said conversion means by forming said test image using a starter developer having a known toner concentration, detecting the amount of adhered toner of said developed test image by said detection means, and comparing the detected result to a predetermined value so as to correct the conversion standard in accordance with said comparison result.

2. The image forming apparatus as claimed in claim 1 further comprising toner replenishment control means for determining the amount of toner replenishment based on said toner concentration converted by said conversion means.

3. The image forming apparatus as claimed in claim 1, wherein said conversion means comprises a plurality of tables expressing the relationship between the amount of adhered toner and toner concentration as conversion standards, and said correction means corrects said conversion standard by selecting one of said plurality of tables.

4. The image forming apparatus as claimed in claim 1 further comprising potential detection means for detecting electrical potential of a latent test image formed on said photosensitive member, wherein said conversion means calculates developing efficiency based on the detected potential and amount of adhered toner, and determines toner concentration in accordance with said developing efficiency.

5. The image forming apparatus as claimed in claim 4 further comprising humidity detection means and temperature detection means, wherein said conversion means corrects the developing efficiency based on said detected humidity and temperature.

6. A toner replenishment method used in an image forming apparatus which develops a latent image formed on a photosensitive member with toner, said toner replenishment method comprising steps of:

forming a latent image of a test pattern under constant image forming conditions;

developing said latent image using a starter developer which has a known toner concentration;

detecting an amount of toner adhered on said test image developed with said starter developer;

determining a relationship between the amount of adhered toner and toner concentration of developer based on said detected amount of toner;

forming a latent image of the test pattern under constant image forming conditions upon every occurrence of events;

developing said latent image using a developer which has an unknown toner concentration;

detecting an amount of toner adhered on said test image developed by said developer having the unknown toner concentration;

estimating said unknown toner concentration based on said determined relationship and said detected amount of toner adhered on the test image developed by said developer having the unknown toner concentration; and determining an amount of toner replenishment based on said estimated toner concentration.

7. The toner replenishment method as claimed in claim 6, wherein said relationship is determined by selecting one among a plurality of tables expressing the relationship between the amount of adhered toner and toner concentration.

* * * * *